United States Patent [19]

Kerber

[11] 4,313,175

[45] Jan. 26, 1982

[54] LINEARIZED MULTIPLIER DEVICE FOR TRIPLE PRODUCT CONVOLVERS

[75] Inventor: George L. Kerber, San Diego, Calif.

[73] Assignee: The United States of America as represented by the Secretary of the Navy, Washington, D.C.

[21] Appl. No.: 137,037

[22] Filed: Apr. 3, 1980

[51] Int. Cl.[3] ..... G06G 7/163; G06G 7/19

[52] U.S. Cl. ..... 364/844; 364/824; 364/861; 364/573; 307/498

[58] Field of Search ..... 364/841, 843, 844, 861, 364/863; 307/491, 495, 498, 501

[56] References Cited

U.S. PATENT DOCUMENTS

| | | | |
|---|---|---|---|
| 3,433,936 | 3/1969 | Blanke | 364/830 |
| 3,448,297 | 6/1969 | Rhodes | 307/498 |
| 3,475,689 | 10/1969 | Gilbert | 364/840 X |
| 3,689,752 | 9/1972 | Gilbert | 364/841 |
| 4,042,815 | 8/1977 | Brown et al. | 364/841 |

*Primary Examiner*—Felix D. Gruber

*Attorney, Agent, or Firm*—Richard S. Sciascia; Ervin F. Johnston; Thomas G. Keough

[57] ABSTRACT

The output signals of a number of variable transconductant multipliers are linerized so as to enable a triple product convolver to calculate Fourier transforms or produce beam forming of signals more accurately. Each of the multipliers includes a differential transistor pair, a current source and an emitter follower all properly interconnected together. The current source and emitter follower function as a linear voltage-to-current converter while differential transistor pair provides for linearity over a preestablished dynamic range. Such linearity is assured by a capacitor coupled between the emitter-base junction of the input transistor of the differential transistor pair. This capacitor has a magnitude equal to the sum of the stray circuit capacitance between the emitters of the differential transistor pair and ground plus the difference between the emitter-base capacitances of the differential transistor pair.

4 Claims, 7 Drawing Figures

LINEARIZED MULTIPLIER DEVICE FOR TRIPLE PRODUCT CONVOLVERS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

A triple product convolver is a device that consists of a tapped delay line with multipliers on each tap and a summing junction, see FIG. 1. The output signal at any instant of time is proportional to the product of chirp signals 1 and 2 signals $S_1, S_2, \ldots, S_n$. This configuration of multipliers and nonlinear elements operatively coupled to a tapped delay line is highly useful in calculating Fourier transforms or for signal beamforming.

A recurring problem confronting designers of convolvers became apparent in the quality of the multipliers' output signals, namely, the problems associated with nonlinearity of signals over a wide dynamic range comprised the convolvers effectiveness. One apparatus and method used to perform the required multiplications use a bipolar transistor in the common base mode as noted in FIG. 2. The output signal is a function of the product of $v_{RF}$ and $I_E$ where $I_E R_E + V_T \ln [I_E/I_{ES}+1] = V_E$ however, $v_o$ is nonlinear function of $V_E$, the modulation signal. To achieve an accurate triple product convolution, $v_o$ must vary linearly with $V_E$. To linearize the functional relationship between $v_o$ and $V_E$, the emitter resistance $R_E$ must be large (about 100 kilohms). This however, reduces the frequency response of the $V_E$ terminal due to the emitter-base capacitance of the transistor. Consequently, this circuit has demonstrated that it is not suitable for linear, high frequency modulation signals which are normally among the signals being processed in fast triple product convolvers.

A variation of a multiplier is depicted in FIG. 3 wherein a dual gate field effect transistor is included in the multiplier. The output signal $v_o$ is a function of the product of $v_{RF}$ with $V_{MOD}$; however, this circuit is linear over a vary limited dynamic range which is typically 15 to 20 db. In addition, there is a rather large variation in the phase of $v_o$ with respect to $v_{RF}$ as $V_{MOD}$ varies. The phase variation is unacceptable for beamforming systems as well as systems for calculating Fourier transforms since their proper operation depends on accurate summing of signals with a precise phase relationship.

Thus, there is a continuing need in the state of the art for a variable transconductance multiplier having a substantially linear response over a wide dynamic range to enhance the performance of vast triple product convolvers.

SUMMARY OF THE INVENTION

The present invention is directed to providing an improvement for a triple product convolver for optionally calculating Fourier transforms or signal beamforming and having a delay line tapped by a plurality of variable transconductance multipliers. A linearizing means is coupled across each transconductive multiplier for linearizing each's impedance to assure that the convolver has an extended range. The linearizing means is preferably a capacitor coupled across the emitter and base junction of the input transistor of each differential transistor pair which is an integral part of each transconductive multiplier.

It is a prime object of the invention to provide improved multipliers for operation in triple product convolvers.

Still another object of the invention is to provide a convolver assuring more linear dynamic bandwidths due to having improved multipliers.

Still another object is to provide variable transconductance multipliers in a triple product convolver made up of differential transistor pairs, current sources and emitter followers to assure more linear operation.

Still another object is to provide variable transconductance multipliers having linearizing elements coupled to assure an extended dynamic range.

Yet another object is to provide differential transistor pairs in a variable transconductance multipliers having linearizing means coupled across the emitter and base junctions of the input transistor of the differential transistor pair.

Still another object is to provide for an improved convolver in which its several multipliers each have capacitors coupled across the emitter and base junctions of the input transistors of the differential transistor pairs.

These and other objects of the invention will become more readily apparent from the ensuing description when taken with the drawings and the appended claims.

DESCRIPTION OF THE PREFERRED EMBODIMENTS

Figure 4:
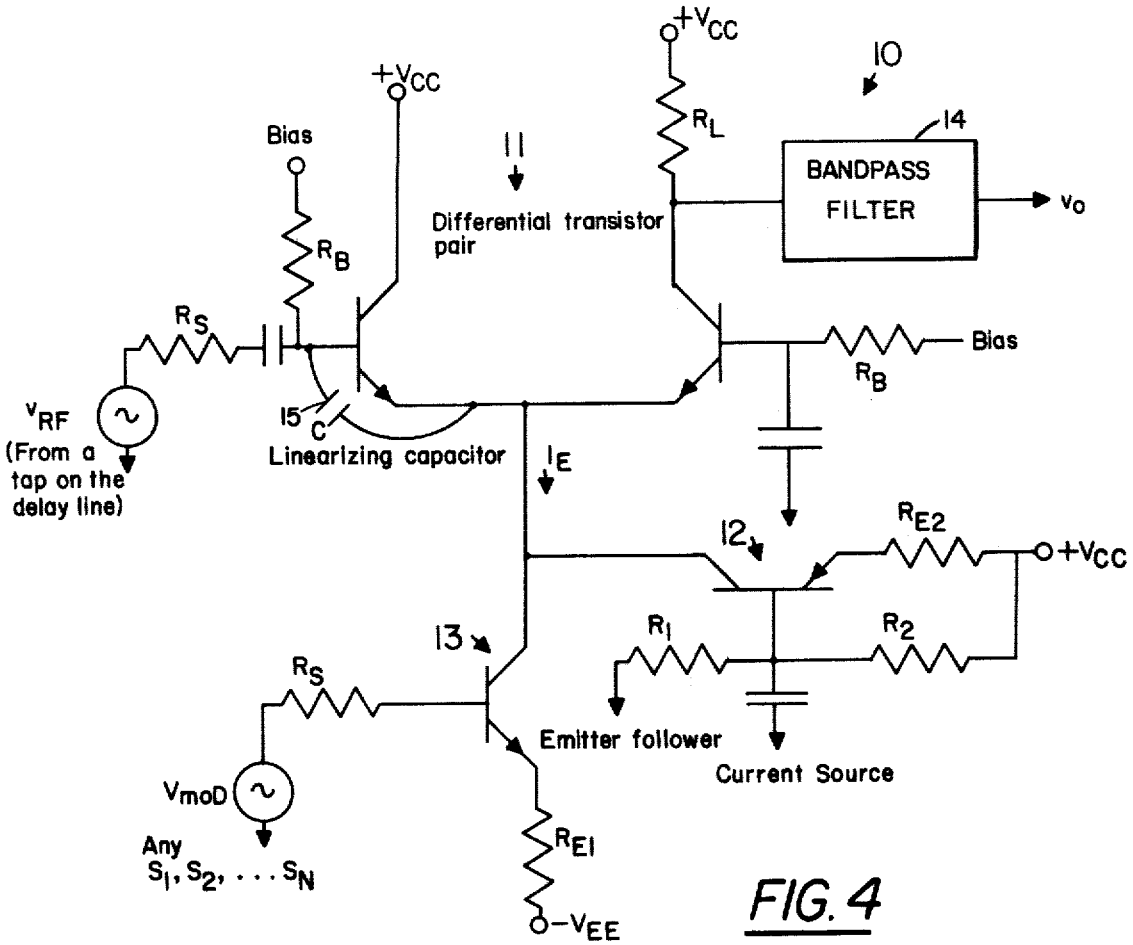
FIG. 4 is a schematical circuit diagram of the invention for assuring improved convolver operation.

Looking now to FIG. 4 of the drawings, an improved variable transconductance multiplier 10 is set forth which avoids the problems which heretofore have compromised the effectiveness of triple product convolvers. The principal elements of the variable transconductor multiplier are a differential transistor pair 11, a current source 12 and emitter follower 13 which are interconnected in accordance with proven design principles. The designations indicating components, parameters, etc. are consistent with well established designations and unnecessary elaboration will be dispensed with to avoid belaboring the obvious.

The current source and emitter follower are used as a linear voltage-to-current converter. The current $I_E$ is made proportional to a modulating signal $V_{MOD}$ (any one of $S_1, S_2, \ldots, S_n$) i.e. $I_E = KV_{MOD} + b$ where k and b are constants determined by actual circuit component values. From a simplified analysis the output signal $v_o$ of the differential transistor pair is given by the expression $$v_o = v_{RF} g_m / 2 R_L \quad (1)$$

provided the output signal is filtered by a bandpass filter 14 to eliminate DC terms and the modulation signal. The transconductance of the differential pair is $g_m = I_E/2V_I$ where $V_T = kT/q$. Clearly $v_o$ is a linear function of the product of $v_{RF}$ and $V_{MOD}$ since $I_E$ is proportional to $V_{MOD}$. Unfortunately, measurements of $I_E$ versus $v_o$ for a constant $v_{RF}$ show that for small values of $I_E$ the functional relationship between $v_o$ and $I_E$ is not linear. This imposes a serious limit on the dynamic range of the transconductance multiplier which in turn limits the accuracy of triple product convolvers.

Figure 5:
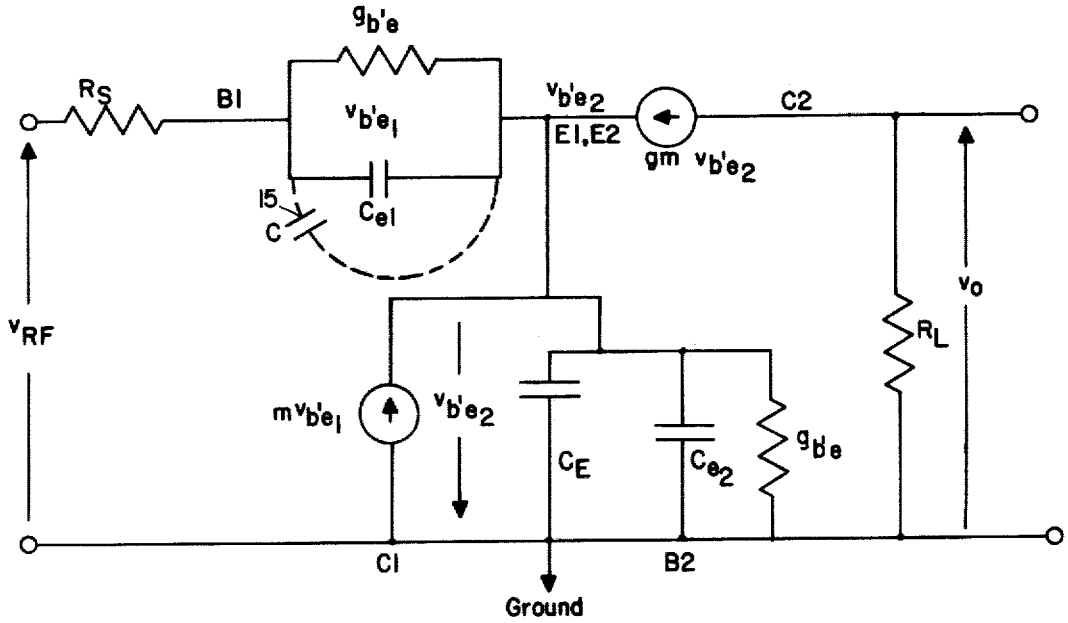
FIG. 5 depicts a hybrid-pi model of the differential amplifier of FIG. 4.

A more detailed analysis of the transconductance multiplier shows that the nonlinearity can be removed by the simple addition of the capacitor 15 coupled between the emitter-base junction of the input transistor of the differential transistor pair, see FIG. 5 for a representation of hybrid-pi model of the differential pair. The value of this linearizing capacitor can be calculated in accordance with established circuit synthesis theory. At this point, it should be pointed out that the capacitor $C_E$ is the stray circuit capacitance between the emitters of the differential transistor pair and ground.

The output voltage in terms of the equivalent circuit elements is given by the expression:

$$v_o = v_{RF} \frac{R_L g_m}{\left\{ 1 + [1 + R_S(g_{b'e} + jwC_e)] \frac{g_m + g_{b'e} + jw(C_{e2} + C_E)}{g_m + g_{b'e} + jwC_{e1}} \right\}}$$

where $g_m = I_E/2V_T$. *At small currents the ratio* $[g_m + g_{b'e} + jw(C_{e2} + C_E)]$ $[g_m + g_{b'e} + jwC_{e1}]$ causes $v_o$ to vary nonlinearly with $I_E$. If a capacitor has a value exactly equal to $C_E + C_{e2} - C_{e1}$, the emitter base capacitance of the input transistor of the differential pair, then the ratio in the denominator of the gain expression exactly cancels. The gain expression reduces to $$v_o = v_{RF} \frac{g_m R_L}{1 + [1 + R_S(g_{b'e} + jwC_e)]}$$

Since $g_m = I_E/2V_T$ and $g_m$ appears only in the numerator, the output voltage $v_o$ is a highly linear function of $I_E$. Moreover, $R_S(g_{b'e} + jwC_e) << 1$ typically. The addition of a capacitance equal to $C_E + C_{e2} - C_{e1}$ exactly cancels the term that contributes to the nonlinearity of $v_o(I_E)$.

Figure 6:
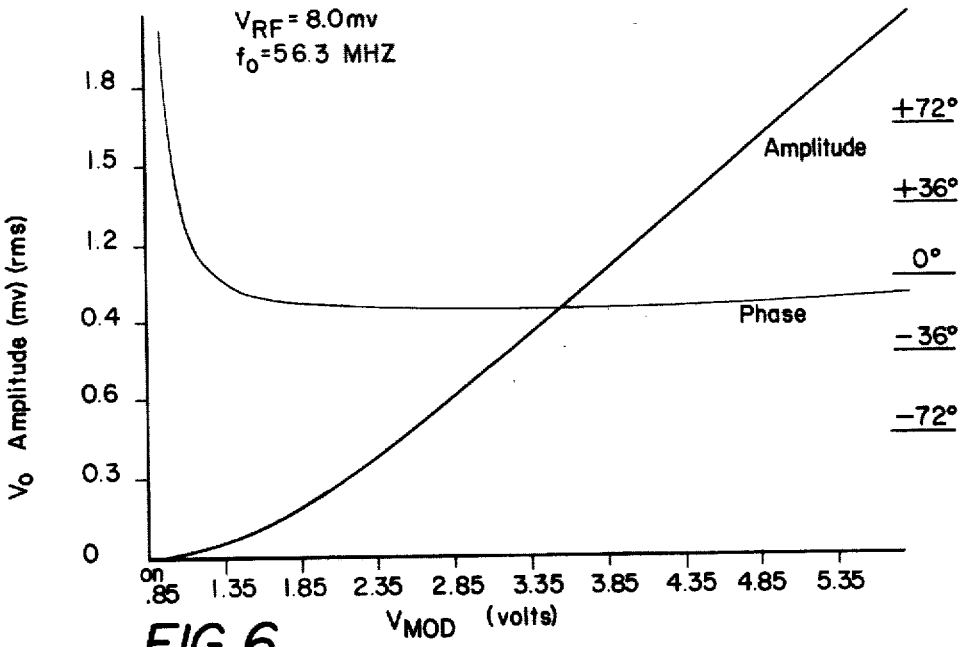
FIGS. 6 and 7 are representations of linearity provided by the improved variable transconductance multiplier with and without a compensating capacitor, respectively.
Figure 7:
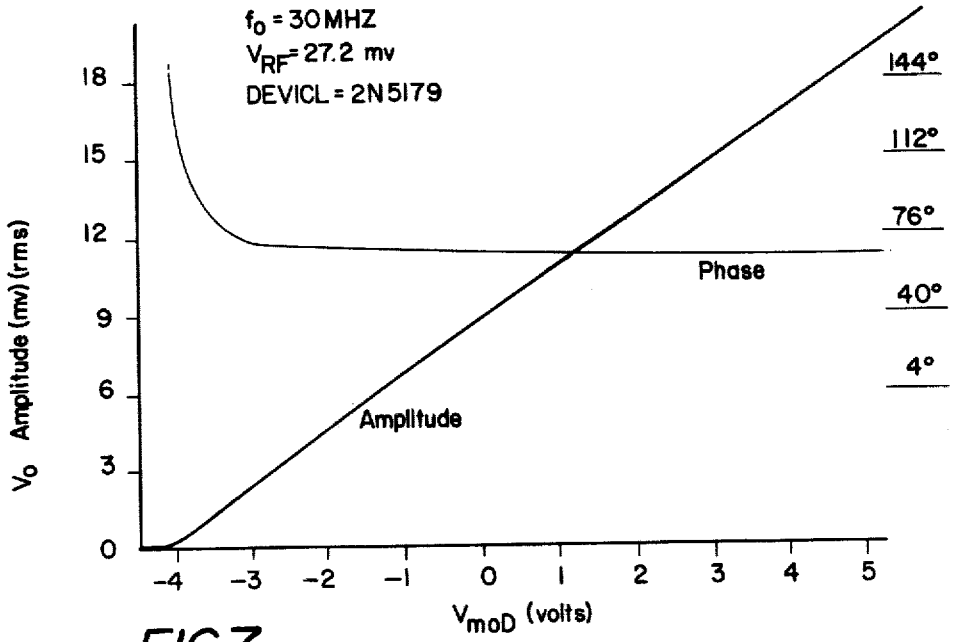

Extended dynamic range linearity is assured by the addition of capacitor 15 across the emitter-base junction of the input transistor of the differential transistor pair. This fact is apparent by comparing the results depicted in FIG. 6 and FIG. 7. FIG. 6 shows a plot of $v_o$ versus $V_{MOD}$ without the compensation capacitor added to the transconductance multiplier. A large deviation from linearity near the origin of the plot is observed. In comparision, FIG. 7 graphically illustrates what the addition of a linearizing capacitor of the proper magnitude will do to the response of the multiplier. Near the origin which corresponds to small currents, the linearity is significantly better than the case shown in FIG. 6. In addition, the linearizing capacitor reduces the phase variation between $v_o$ and $v_{RF}$ which is extremely important for high accuracy product convolvers.

Figure 1:
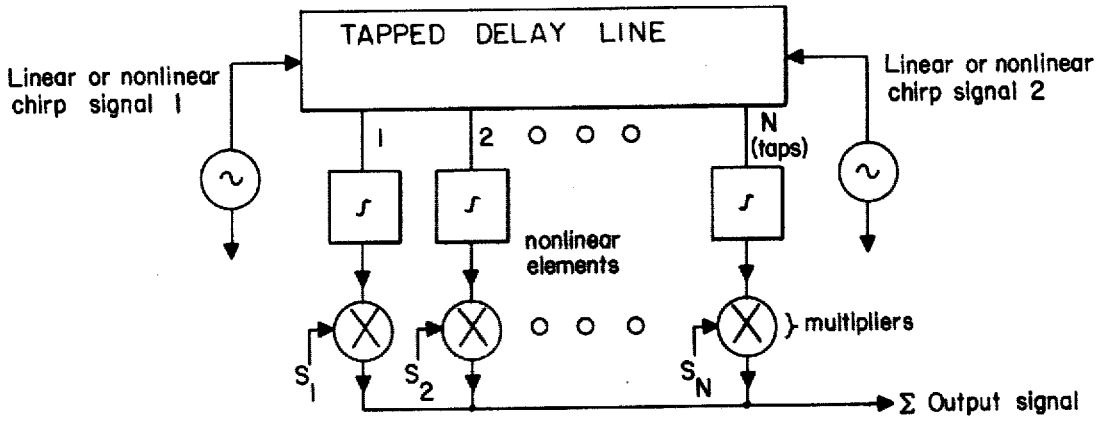
FIG. 1 is a schematic representation of a triple product convolver of the type adapting the novel features of this invention.
Figure 2:
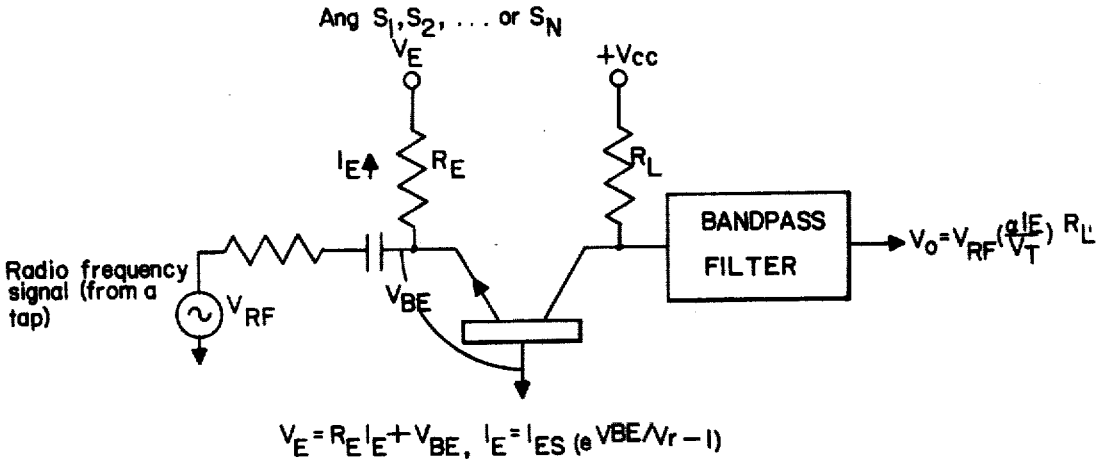
FIG2 Prior Art
FIG. 2 depicts a prior art multiplier sometimes referred to as employing a bipolar transistor.
Figure 3:
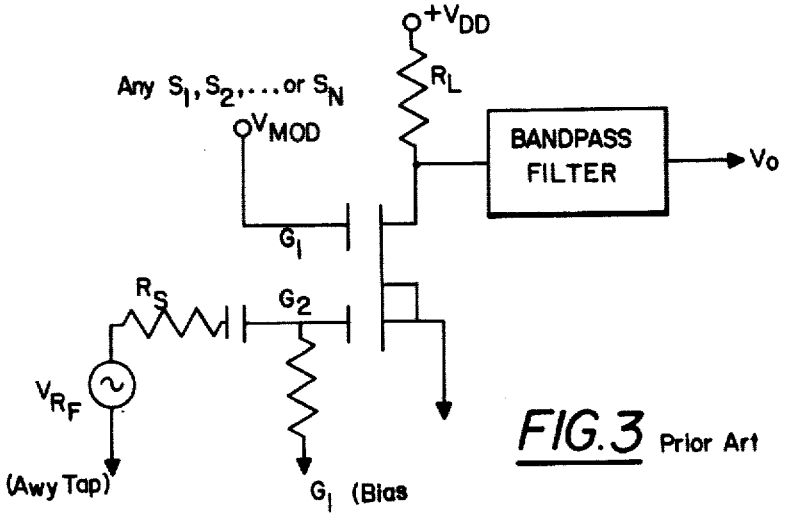
FIG.3 Prior Art
FIG. 3 shows yet another variation of a prior art multiplier using a dual gate field effect transistor.

Inclusion of the compensation capacitor in the transconductance multiplier results in a significant improvement in linearity over the single transistor circuit shown in FIG. 2, the dual field gate effect transistor depicted in FIG. 3 and a conventional, noncompensated transconductance multiplier. Furthermore, the compensation capacitor assures a significant reduction of phase variation over the other methods discussed hereinabove. The high degree of linearity of a transconductance multiplier fabricated in accordance with the addition of the linerizing capacitor as taught by this invention will enable the construction of more accurate triple product convolvers and modulators.

Obviously, many other modifications and variations of the present invention are possible in the light of the above teachings. It is therefore to be understood that within the scope of the appended claims the invention may be practiced otherwise than as specifically described.

What is claimed is:

1. In a convolver for optionally calculating Fourier transforms or beamforming and having a delay line tapped by a plurality of variable transconductance multipliers each including a differential transistor pair an improvement therefor is provided comprising:

means coupled across the emitter and base junction of the input transistor of each differential transistor pair for linearizing the impedance of each transconductive multiplier to assure an extended dynamic range of the convolver.

2. An improved convolver according to claim 1 in which an impedance linearizing means is coupled across the emitter and base junction of the input transistor of the differential transistor pair.

3. An improved convolver according to claim 2 in which the impedance linearizing means in a capacitor.

4. An improved convolver according to claim 3 in which the capacitor has a value equal to the stray circuit capacitance of the emitters of the differential transistor pair and ground plus the difference between the emitter base capacitance of the differential transistor pair.

* * * * *